US010867579B2

(12) United States Patent
Sun et al.

(10) Patent No.: US 10,867,579 B2
(45) Date of Patent: Dec. 15, 2020

(54) DATA PROCESSING METHOD AND DEVICE, DRIVING METHOD, DISPLAY PANEL AND STORAGE MEDIUM

(71) Applicant: BOE TECHNOLOGY GROUP CO., LTD., Beijing (CN)

(72) Inventors: Yan Sun, Beijing (CN); Xiaomang Zhang, Beijing (CN); Yanhui Xi, Beijing (CN); Chuan Shuai, Beijing (CN); Bin Dai, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/400,597

(22) Filed: May 1, 2019

(65) Prior Publication Data

US 2020/0027421 A1 Jan. 23, 2020

(30) Foreign Application Priority Data

Jul. 23, 2018 (CN) ..... 2018 1 0813985

(51) Int. Cl.

*G09G 5/02* (2006.01)
*G09G 3/36* (2006.01)
*G09G 5/04* (2006.01)

(52) U.S. Cl.

CPC ..... *G09G 5/026* (2013.01); *G09G 3/3607* (2013.01); *G09G 5/028* (2013.01); *G09G 5/04* (2013.01);

(Continued)

(58) Field of Classification Search

CPC .... G09G 5/02; G09G 5/06; G09G 2320/0666; G09G 5/363; G06T 11/001

(Continued)

(56) References Cited

U.S. PATENT DOCUMENTS

2002/0122019 A1* 9/2002 Baba ..... G02B 26/008 345/88
2003/0011613 A1 1/2003 Booth, Jr.

(Continued)

FOREIGN PATENT DOCUMENTS

CN 101860762 A 10/2010
CN 103218988 A 7/2013

(Continued)

OTHER PUBLICATIONS

Chinese Office Action in Chinese Application No. 201810813985.8, dated Jul. 3, 2020 with English translation.

*Primary Examiner* — Gordon G Liu
(74) *Attorney, Agent, or Firm* — Collard & Roe, P.C.

(57) ABSTRACT

A data processing method, an image display driving method, a data processing device, a display panel and a computer-readable storage medium are provided. The data processing method includes: based on input RGB grayscale values, calculating a chromaticity coordinate of the input RGB grayscale values on a chromaticity diagram, in which the chromaticity diagram includes a white basic point; calculating to obtain intermediate grayscale values containing a white component, based on the input RGB grayscale values and according to a position relationship between the chromaticity coordinate and the white basic point; and adjusting the intermediate grayscale values to obtain output RGBW grayscale values.

13 Claims, 3 Drawing Sheets

(52) U.S. Cl.
CPC . *G09G 2300/0452* (2013.01); *G09G 2340/06* (2013.01)

(58) Field of Classification Search
USPC ..... 345/600
See application file for complete search history.

(56) References Cited

U.S. PATENT DOCUMENTS

| | | | | |
|---|---|---|---|---|
| 2005/0225561 | A1* | 10/2005 | Higgins | G09G 5/02 345/600 |
| 2007/0139437 | A1* | 6/2007 | Boroson | H01L 27/3213 345/590 |
| 2015/0154762 | A1 | 6/2015 | Yang et al. | |
| 2017/0256190 | A1 | 9/2017 | Jin | |
| 2020/0143732 | A1 | 5/2020 | Xi et al. | |

FOREIGN PATENT DOCUMENTS

| | | | |
|---|---|---|---|
| CN | 105118413 | A | 12/2015 |
| CN | 107945729 | A | 4/2018 |
| JP | 2006-163425 | A | 6/2006 |

* cited by examiner

CIE1931 chromaticity diagram

DATA PROCESSING METHOD AND DEVICE, DRIVING METHOD, DISPLAY PANEL AND STORAGE MEDIUM

The present application claims the priority of Chinese Patent Application No. 201810813985.8 filed on Jul. 23, 2018, which is incorporated herein by reference as a part of the present application.

TECHNICAL FIELD

Embodiments of the present disclosure relate to a data processing method, a data processing device, an image display driving method, a display panel and a computer-readable storage medium.

BACKGROUND

A thin film transistor liquid crystal display (TFT-LCD) is widely used in a liquid crystal TV, a mobile phone, a computer and other electronic products due to its advantages of high resolution, power saving and light frame. With development of liquid crystal display technology, traditional RGB (red, green, blue) tricolor display technology has been unable to meet the requirements of high brightness and low power consumption of electronic products. Therefore, multi-color display technology has gradually developed. RGBW (red, green, blue, white) four-color display technology is to add a W (white) sub-pixel on the basis of a RGB pixel unit structure to form a RGBW pixel structure. The RGBW four-color display technology has the advantages of improving the transmittance, improving brightness and reducing power consumption of an LCD panel.

SUMMARY

At least one embodiment of the present disclosure provides a data processing method, and the data processing method comprises: based on input RGB grayscale values, calculating a chromaticity coordinate of the input RGB grayscale values on a chromaticity diagram, in which the chromaticity diagram comprises a white basic point; calculating to obtain intermediate grayscale values containing a white component, based on the input RGB grayscale values and according to a position relationship between the chromaticity coordinate and the white basic point; and adjusting the intermediate grayscale values to obtain output RGBW grayscale values.

For example, in the data processing method provided by at least one embodiment of the present disclosure, the input RGB grayscale values comprise an input R sub-grayscale value, an input G sub-grayscale value and an input B sub-grayscale value; and calculating the chromaticity coordinate of the input RGB grayscale values on the chromaticity diagram based on the input RGB grayscale values, comprises: calculating tri-stimulus values of the chromaticity coordinate according to the input RGB grayscale values; and calculating the chromaticity coordinate according to the tri-stimulus values, in which a formula for calculating the tri-stimulus value is expressed as:

$$\begin{pmatrix} X_0 \\ Y_0 \\ Z_0 \end{pmatrix} = \begin{pmatrix} X_R & X_G & X_B & X_w \\ Y_R & Y_G & Y_B & Y_w \\ Z_R & Z_G & Z_B & Z_w \end{pmatrix} \begin{pmatrix} R_0 \\ G_0 \\ B_0 \\ 0 \end{pmatrix}$$

in which $X_0$, $Y_0$ and $Z_0$ represent the tri-stimulus values, and $Y_0$ represents an actual brightness value under the input RGB graysc ale values, $R_0$ represents the input R sub-grayscale value, $G_0$ represents the input G sub-grayscale value, $B_0$ represents the input B sub-grayscale value, and $X_R$, $Y_R$, $Z_R$, $X_G$, $Y_G$, $Z_G$, $X_B$, $Y_B$, $Z_B$, $X_W$, $Y_W$, and $Z_W$ are conversion coefficients and are constants;

formulas for calculating the chromaticity coordinate $x_0$ and $y_0$ are expressed as follows:

$$x_0 = \frac{X_0}{X_0 + Y_0 + Z_0},\ y_0 = \frac{Y_0}{X_0 + Y_0 + Z_0}.$$

For example, in the data processing method provided by at least one embodiment of the present disclosure, the chromaticity diagram further comprises a red basic point, a green basic point and a blue basic point; and calculating to obtain the intermediate grayscale values containing the white component, based on the input RGB grayscale values and according to the position relationship between the chromaticity coordinate and the white basic point comprises: determining the position relationship between the chromaticity coordinate and the white basic point according to the red basic point, the green basic point, the blue basic point, the white basic point and the chromaticity coordinate; and according to the position relationship, calculating the intermediate grayscale values based on the input RGB grayscale values.

For example, in the data processing method provided by at least one embodiment of the present disclosure, the intermediate grayscale values comprise a first intermediate sub-grayscale value, a second intermediate sub-grayscale value and a third intermediate sub-grayscale value; in the chromaticity diagram, a triangular region with the red basic point, the green basic point and the white basic point as vertices is a first region, a triangular region with the red basic point, the blue basic point and the white basic point as vertices is a second region, and a triangular region with the green basic point, the blue basic point and the white basic point as vertices is a third region;

in a case where the position relationship is that the chromaticity coordinate is located in the first region, a formula for calculating the intermediate grayscale values is expressed as:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} R_1 \\ G_1 \\ 0 \\ W_1 \end{pmatrix}$$

in which $R_1$, $G_1$ and $W_1$ represent the first intermediate sub-grayscale value, the second intermediate sub-grayscale value and the third intermediate sub-grayscale value respectively; or, in a case where the position relationship is that the chromaticity coordinate is located in the second region, a formula for calculating the intermediate grayscale values is expressed as:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} R_1 \\ 0 \\ B_1 \\ W_1 \end{pmatrix}$$

in which $R_1$, $B_1$ and $W_1$ represent the first intermediate sub-grayscale value, the second intermediate sub-grayscale value and the third intermediate sub-grayscale value respectively; or, in a case where the position relationship is that the chromaticity coordinate is located in the third region, a formula for calculating the intermediate grayscale values is expressed as:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} 0 \\ G_1 \\ B_1 \\ W_1 \end{pmatrix}$$

in which $G_1$, $B_1$ and $W_1$ represent the first intermediate sub-grayscale value, the second intermediate sub-grayscale value and the third intermediate sub-grayscale value respectively.

For example, in the data processing method provided by at least one embodiment of the present disclosure, adjusting the intermediate grayscale values to obtain the output RGBW grayscale values comprises: adjusting the intermediate grayscale values to obtain the output RGBW grayscale values according to a brightness information included in the input RGB grayscale values.

For example, in the data processing method provided by at least one embodiment of the present disclosure, adjusting the intermediate grayscale values to obtain the output RGBW grayscale values according to the brightness information included in the input RGB grayscale values comprises: calculating a maximum brightness value corresponding to the chromaticity coordinate according to the input RGB grayscale values; adjusting the intermediate grayscale values to obtain the output RGBW grayscale values according to the input RGB grayscale values and the maximum brightness value.

For example, in the data processing method provided by at least one embodiment of the present disclosure, calculating a maximum brightness value corresponding to the chromaticity coordinate according to the input RGB grayscale values comprises: obtaining a maximum value among the input R sub-grayscale value, the input G sub-grayscale value and the input B sub-grayscale value as a maximum input sub-grayscale value; and calculating the maximum brightness value based on the maximum input sub-grayscale value and the input RGB grayscale values, in which a formula for calculating the maximum brightness value is expressed as:

$$\begin{pmatrix} X_{max} \\ Y_{max} \\ Z_{max} \end{pmatrix} = \begin{pmatrix} X_R & X_G & X_B & X_w \\ Y_R & Y_G & Y_B & Y_w \\ Z_R & Z_G & Z_B & Z_w \end{pmatrix} \frac{1}{K_{RGB}} \begin{pmatrix} R_0 \\ G_0 \\ B_0 \\ 0 \end{pmatrix},$$

in which $X_{max}$, $Y_{max}$ and $Z_{max}$ represent tri-stimulus values corresponding to the maximum brightness value of the chromaticity coordinate, $Y_{max}$ represents the maximum brightness value, and $K_{RGB}$ represents the maximum input sub-grayscale value.

For example, in the data processing method provided by at least one embodiment of the present disclosure, adjusting the intermediate grayscale values to obtain the output RGBW grayscale values according to the input RGB grayscale values and the maximum brightness value comprises: calculating the intermediate output RGBW grayscale values according to the input RGB grayscale values and the intermediate grayscale values, in which the intermediate output RGBW grayscale values comprise an intermediate output R sub-grayscale value, an intermediate output G sub-grayscale value, an intermediate output B sub-grayscale value and an intermediate output W sub-grayscale value; obtaining a maximum value among the intermediate output R sub-grayscale value, the intermediate output G sub-grayscale value, the intermediate output B sub-grayscale value and the intermediate output W sub-grayscale value as a maximum intermediate output sub-grayscale value; calculating the output RGBW grayscale values according to the intermediate output RGBW grayscale values, the maximum intermediate output sub-grayscale value, the maximum brightness value and the actual brightness value.

For example, in the data processing method provided by at least one embodiment of the present disclosure, in the case where the position relationship is that the chromaticity coordinate is located in the first region, a formula for calculating the intermediate output RGBW grayscale values is expressed as:

$$\begin{pmatrix} R_2 \\ G_2 \\ B_2 \\ W_2 \end{pmatrix} = \begin{pmatrix} R_0 \\ G_0 \\ B_0 \\ 0 \end{pmatrix} + \begin{pmatrix} R_1 \\ G_1 \\ 0 \\ W_1 \end{pmatrix}$$

or, in the case where the position relationship is that the chromaticity coordinate is located in the second region, a formula for calculating the intermediate output RGBW grayscale values is expressed as:

$$\begin{pmatrix} R_2 \\ G_2 \\ B_2 \\ W_2 \end{pmatrix} = \begin{pmatrix} R_0 \\ G_0 \\ B_0 \\ 0 \end{pmatrix} + \begin{pmatrix} R_1 \\ 0 \\ B_1 \\ W_1 \end{pmatrix}$$

or, in the case where the position relationship is that the chromaticity coordinate is located in the third region, a formula for calculating the intermediate output RGBW grayscale values is expressed as:

$$\begin{pmatrix} R_2 \\ G_2 \\ B_2 \\ W_2 \end{pmatrix} = \begin{pmatrix} R_0 \\ G_0 \\ B_0 \\ 0 \end{pmatrix} + \begin{pmatrix} 0 \\ G_1 \\ B_1 \\ W_1 \end{pmatrix}$$

in which $R_2$, $G_2$, $B_2$ and $W_2$ represent the intermediate output R sub-grayscale value, the intermediate output G sub-grayscale value, the intermediate output B sub-grayscale value and the intermediate output W sub-grayscale value respectively.

For example, in the data processing method provided by at least one embodiment of the present disclosure, a formula for calculating the output RGBW grayscale values is expressed as:

$$\begin{pmatrix} R_{out} \\ G_{out} \\ B_{out} \\ W_{out} \end{pmatrix} = \frac{Y_0}{Y_{max} \cdot K_m} \begin{pmatrix} R_2 \\ G_2 \\ B_2 \\ W_2 \end{pmatrix}$$

in which $R_{out}$, $G_{out}$, $B_{out}$ and $W_{out}$ represent an output R sub-grayscale value, an output G sub-grayscale value, an output B sub-grayscale value and an output W sub-grayscale value of the output RGBW grayscale values respectively, and $K_m$ represents the maximum intermediate output sub-grayscale value.

At least one embodiment of the present disclosure further comprises an image display driving method, and the image display driving method comprises: obtaining input RGB grayscale values; based on the input RGB grayscale values, calculating a chromaticity coordinate of the input RGB grayscale values on a chromaticity diagram, in which the chromaticity diagram comprises a white basic point; calculating to obtain intermediate grayscale values containing a white component, based on the input RGB grayscale values and according to a position relationship between the chromaticity coordinate and the white basic point; adjusting the intermediate grayscale values to obtain output RGBW grayscale values; and driving a display pixel to display by using the output RGBW grayscale values.

For example, in the image display driving method provided by at least one embodiment of the present disclosure, the display pixel comprises a first sub-pixel, a second sub-pixel, a third sub-pixel and a fourth sub-pixel; an output R sub-grayscale value of the output RGBW grayscale values is transmitted to the first sub-pixel to drive the first sub-pixel to display; an output G sub-grayscale value of the output RGBW grayscale values is transmitted to the second sub-pixel to drive the second sub-pixel to display; an output B sub-grayscale value of the output RGBW grayscale values is transmitted to the third sub-pixel to drive the third sub-pixel to display; and an output W sub-grayscale value of the output RGBW grayscale values is transmitted to the fourth sub-pixel to drive the fourth sub-pixel to display.

At least one embodiment of the present disclosure further comprises a data processing device, and the data processing device comprises: a data acquisition module, configured to acquire input RGB grayscale values; a grayscale conversion module, which is configured for: based on the input RGB grayscale values, calculating a chromaticity coordinate of the input RGB grayscale values on a chromaticity diagram, in which the chromaticity diagram comprises a white basic point, calculating to obtain intermediate grayscale values containing a white component, based on the input RGB grayscale values and according to a position relationship between the chromaticity coordinate and the white basic point, and adjusting the intermediate grayscale values to obtain output RGBW grayscale values; and an output module, which is configured for transmitting the output RGBW grayscale values to a display pixel to drive the display pixel to display.

At least one embodiment of the present disclosure further comprises a data processing device, and the data processing device comprises a storage, which is used for storing a non-temporary computer-readable instruction; and a processor, which is used for executing the non-temporary computer-readable instruction, in which the non-temporary computer-readable instruction is executed by the processor to perform any one of the data processing methods described above.

At least one embodiment of the present disclosure further comprises a display panel, and the display panel comprises any one of the data processing devices described above.

At least one embodiment of the present disclosure further provides a computer-readable storage medium, and the computer-readable storage medium is used for storing a non-temporary computer-readable instruction, in which the non-temporary computer-readable instruction is executed by a computer to perform any one of the data processing methods described above.

BRIEF DESCRIPTION OF THE DRAWINGS

In order to clearly illustrate the technical solution of the embodiments of the present disclosure, the drawings of the embodiments will be briefly described. It is apparent that the described drawings are only related to some embodiments of the present disclosure and thus are not limitative of the present disclosure.

DETAILED DESCRIPTION

Figure 1:
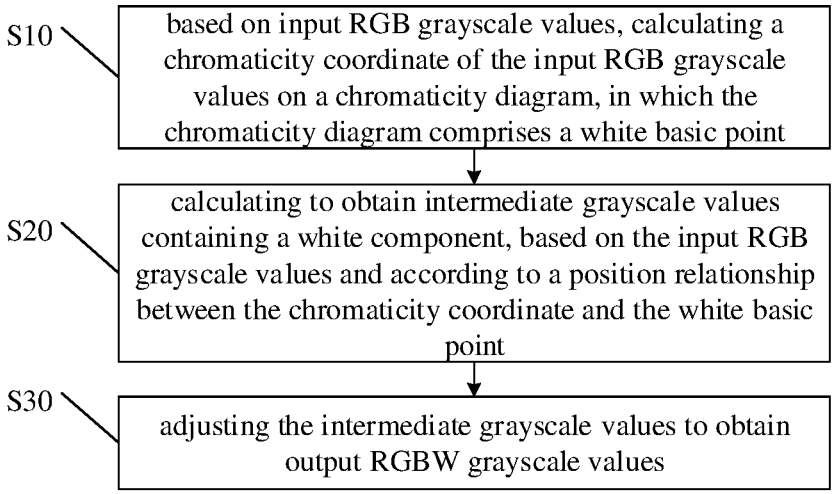
FIG. 1 is a flowchart of a data processing method provided by at least an embodiment of the present disclosure.

In order to make objects, technical details and advantages of embodiments of the disclosure clear, the technical solutions of the embodiments will be described in a clearly and fully understandable way in connection with the related drawings. It is apparent that the described embodiments are just a part but not all of the embodiments of the disclosure. Based on the described embodiments herein, those skilled in the art can obtain, without any inventive work, other embodiment(s) which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and claims of the present application, are not intended to indicate any sequence, amount or importance, but to distinguish various components. The terms "comprises," "comprising," "includes," "including," etc., are intended to specify that the elements or the objects stated before these terms encompass the elements or the objects listed after these terms as well as equivalents thereof, but do not exclude other elements or objects. The phrases "connect", "connected", etc., are not intended to define a physical connection or mechanical connection, but may include an electrical connection which is direct or indirect. The terms "on," "under," "right," "left" and the like are only used to indicate relative position relationship, and when the position of an object is described as being changed, the relative position relationship may be changed accordingly. In order to make the following description of the embodiments of the present disclosure clear and concise, the present disclosure omits detailed description of known functions and known components.

RGBW (red, green, blue, white) four-color display technology can enhance display brightness effectively, or reduce power consumption under the same brightness. However, a RGB color conversion theory is mature. At present, most data sources are encoded based on RGB, so input signals of the display panel are three signals of the RGB. An additional W signal makes color saturation of a display screen decrease relative to an original screen, that is, the displayed color is diluted by the added white light, resulting in a phenomenon of color fading. How to convert RGB three-color signals into RGBW four-color signals without distortion becomes a technical difficulty of the RGBW four-color display technology.

Embodiments of the present disclosure provide a data processing method, a data processing device, an image display driving method, a display panel and a computer-readable storage medium, in the data processing method, according to a position relationship between a chromaticity coordinate of input RGB grayscale values and a white basic point, the white component of output RGBW grayscale values is determined, so as to solve a problem of color matching in the process of conversion from RGB to RGBW, and ensure that the color is not distorted (the chromaticity coordinate is unchanged before and after conversion), and effectively improve the brightness and the display effect. At the same time, the data processing method is simple and the amount of calculation is small. The data processing method provided by the embodiments of the present disclosure can be applied to various suitable types of display panels, such as an LCD display panel, an OLED display panel, etc.

The embodiments of the present disclosure are described in detail below, but the present disclosure is not limited to these specific embodiments.

Figure 2:
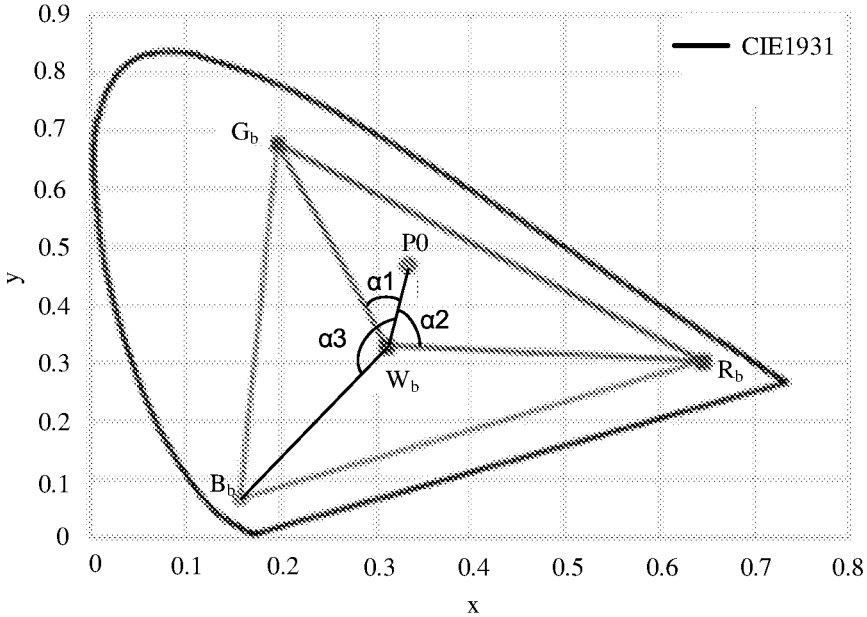
FIG. 2 is a schematic diagram of a CIE1931 chromaticity diagram.

FIG. 1 is a flowchart of a data processing method provided by at least an embodiment of the present disclosure, and FIG. 2 is a schematic diagram of a CIE1931 chromaticity diagram.

For example, as illustrated in FIG. 1, the data processing method provided by the embodiment of the present disclosure comprises:

S10: based on input RGB grayscale values, calculating a chromaticity coordinate of the input RGB grayscale values on a chromaticity diagram, in which the chromaticity diagram comprises a white basic point;

S20: calculating to obtain intermediate grayscale values containing a white component, based on the input RGB grayscale values and according to a position relationship between the chromaticity coordinate and the white basic point;

S30: adjusting the intermediate grayscale values to obtain output RGBW grayscale values.

The input RGB grayscale values are obtained, for example, by decoding a display data signal from a data source. The data source comprises a storage device or a data receiving device, or the like. For example, the storage device comprises a hard disk, a flash memory, etc., and the data receiving device comprises a modem, a wired network card, and a wireless network card, etc.

For example, the chromaticity diagram is a planar diagram where a functional expression v=f(u) of a blackbody trajectory is expressed by the chromaticity coordinates in colorimetry. As illustrated in FIG. 2, the chromaticity diagram is a CIE1931 chromaticity diagram, which uses a brightness parameter Y and a color coordinate (x, y) to describe color. Points on an arc curve of the CIE1931 chromaticity diagram are chromaticity coordinates of various colors (that is spectral trajectories) in the spectrum. In the CIE 1931 chromaticity diagram, an X-axis chromaticity coordinate corresponds to a proportion of a red primary color of a certain color; a Y-axis chromaticity coordinate corresponds to a proportion of a green primary color of the certain color. The CIE 1931 chromaticity diagram comprises a red basic point ($R_b$), a green basic point ($G_b$), a blue basic point ($B_b$), and a white basic point ($W_b$) may be obtained on the basis of the above red basic point, the green basic point and the blue basic point. By these basic points, the coordinates of different colors in the CIE1931 chromaticity diagram can be obtained. For example, the red basic point ($R_b$), the green basic point ($G_b$), the blue basic point ($B_b$) and the white basic point ($W_b$) may form a RGBW color space.

For example, because the red, green and blue primary colors selected from the actual spectrum cannot be mixed to obtain all the colors that exist in nature. In 1931, CIE (International Lighting Commission) theoretically assumed that there are three primary colors that do not exist in nature, that is theoretical three primary colors, which are represented by X, Y and Z respectively. X theory primary color is equivalent to a red purple color having a higher saturation than red light; Y theory primary color is equivalent to a green color having a higher saturation than green light of 520 nanometer, Z theory primary color is equivalent to a blue color having a higher saturation than blue light of 477 nanometer. Tri-stimulus values are amounts of stimulation of three theoretical primary colors which cause the sensation of a certain color in human retina. The stimulation amounts of the theoretical primary colors are expressed as X, Y and Z (that is, tri-stimulus values). In the CIE1931 chromaticity diagram, for a RGB three-color system, a conversion formula between RGB grayscale values and the tri-stimulus values is expressed as follows:

$$\begin{pmatrix} X \\ Y \\ Z \end{pmatrix} = \begin{pmatrix} X1_R & X1_G & X1_B \\ Y1_R & Y1_G & Y1_B \\ Z1_R & Z1_G & Z1_B \end{pmatrix} \cdot \begin{pmatrix} R \\ G \\ B \end{pmatrix}$$

in which, R, G and B respectively represent a R grayscale value, a B grayscale value and a G grayscale value corresponding to a certain mixed color. X, Y and Z are tri-stimulus values of the mixed color, and the X, Y and Z all are positive numbers. $X1_R$, $X1_G$, $X1_B$, $Y1_R$, $Y1_G$, $Y1_B$, $Z1_R$, $Z1_G$ and $Z1_B$ are three-color conversion coefficients, and the $X1_R$, $X1_G$, $X1_B$, $Y1_R$, $Y1_G$, $Y1_B$, $Z1_R$, $Z1_G$ and $Z1_B$ are determined by the performance of the display panel. X denotes a stimulus value of theoretical red primary color, Y denotes a stimulus value of theoretical green primary color, Z denotes a stimulus value of theoretical blue primary color, and the Y stimulus value is the same as a brightness value, that is, the Y stimulus value can denote the brightness value.

For example, the $X1_R$, $X1_G$, $X1_B$, $Y1_R$, $Y1_G$, $Y1_B$, $Z1_R$, $Z1_G$ and $Z1_B$ can be measured by a color analyzer, the color analyzer adopted, for example, is a commercially suitable color analyzer (for example, a type of the color analyzer is CA-310 or CA-210).

For example, in some examples, $X1_R$=0.4124, $X1_G$=0.3576, $X1_B$=0.1805, $Y1_R$=0.2126, $Y1_G$=0.7152, $Y1_B$=0.0722, $Z1_R$=0.0193, $Z1_G$=0.1192, $Z1_B$=0.9505. That is to say, the conversion formula between the RGB grayscale values and the tri-stimulus values is expressed as follows:

$$\begin{pmatrix} X \\ Y \\ Z \end{pmatrix} = \begin{pmatrix} 0.4124 & 0.3576 & 0.1805 \\ 0.2126 & 0.7152 & 0.0722 \\ 0.0193 & 0.1192 & 0.9505 \end{pmatrix} \cdot \begin{pmatrix} R \\ G \\ B \end{pmatrix}$$

For example, similar to the RGB three-color system, in a RGBW four-color system, a conversion formula between the RGBW grayscale values and the tri-stimulus values is expressed as follows:

$$\begin{pmatrix} X \\ Y \\ Z \end{pmatrix} = \begin{pmatrix} X2_R & X2_G & X2_B & X2_W \\ Y2_R & Y2_G & Y2_B & Y2_W \\ Z2_R & Z2_G & Z2_B & Z2_W \end{pmatrix} \cdot \begin{pmatrix} R \\ G \\ B \\ W \end{pmatrix}$$

in which the R, G, B and W respectively represent a R grayscale value, a B grayscale value, a G grayscale value and a W grayscale value corresponding to a certain mixed color, X, Y and Z are tri-stimulus values of the mixed color. The $X2_R$, $X2_G$, $X2_B$, $X2_W$, $Y2_R$, $Y2_G$, $Y2_B$, $Y2_W$, $Z2_R$, $Z2_G$, $Z2_B$ and $Z2_W$ are four-color conversion coefficients. The $X2_R$, $X2_G$, $X2_B$, $X2_W$, $Y2_R$, $Y2_G$, $Y2_B$, $Y2_W$, $Z2_R$, $Z2_G$, $Z2_B$, $Z2_W$ can also be determined by the performance of the display panel, and can be measured by the color analyzer. For example, in some examples, the conversion relationship formula the RGBW grayscale values and the tri-stimulus values is expressed as:

$$\begin{pmatrix} X \\ Y \\ Z \end{pmatrix} = \begin{pmatrix} 0.2440 & 0.2472 & 0.5961 & 0.3692 \\ 0.1299 & 0.4487 & 0.0365 & 0.3848 \\ 0.0097 & 0.0798 & 0.3348 & 0.4553 \end{pmatrix} \cdot \begin{pmatrix} R \\ G \\ B \\ W \end{pmatrix} \quad (1)$$

For example, the conversion formula between the chromaticity coordinate and the tri-stimulus values is expressed as follows:

$$x = \frac{X}{X+Y+Z},\ y = \frac{Y}{X+Y+Z},\ z = \frac{Z}{X+Y+Z}$$

in which, the x and y are the chromaticity coordinate of the RGB grayscale values or the RGBW grayscale values on the CIE1931 chromaticity diagram.

For example, in step S10, the input RGB grayscale values can comprise an input R sub-grayscale value (that is, an input red sub-grayscale value), an input G sub-grayscale value (that is, an input green sub-grayscale value) and an input B sub-grayscale value (that is, an input blue sub-grayscale value). The input RGB grayscale values are normalized values, that is, all the input R sub-grayscale value, the input G sub-grayscale value and the input B sub-grayscale value are in a range of 0.00 to 1.00. For example, if each pixel of the display panel is represented by 8-bit data, the grayscale levels of the display panel comprises 256 grayscale levels (from a 0 grayscale to a 255 grayscale), and 0.00 corresponds to the 0 grayscale, and 1.00 corresponds to the 255 grayscale.

For example, step S10 may comprise: calculating tri-stimulus values of the chromaticity coordinate according to the input RGB grayscale values; and calculating the chromaticity coordinate according to the tri-stimulus values.

For example, based on the above theory, in the RGBW four-color system, in step S10, a formula for calculating the tri-stimulus values is expressed as:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} R_0 \\ G_0 \\ B_0 \\ W_0 \end{pmatrix}$$

in which, $X_0$, $Y_0$ and $Z_0$ represent the tri-stimulus values, and $Y_0$ represents an actual brightness value under the input RGB grayscale values, $R_0$ represents the input R sub-grayscale value, $G_0$ represents the input G sub-grayscale value, $B_0$ represents the input B sub-grayscale value, $W_0$ represents the input W sub-grayscale value (that is, an input white sub-grayscale value), $X_R$, $Y_R$, $Z_R$, $X_G$, $Y_G$, $Z_G$, $X_B$, $Y_B$, $Z_B$, $X_W$, $Y_W$ and $Z_W$ are all conversion coefficients and are constants. For example, in some examples, as described above, $X_R$=0.2440, $X_G$=0.2472, $X_B$=0.5961, $X_W$=0.3692, $Y_R$=0.1299, $Y_G$=0.4487, $Y_B$=0.0365, $Y_W$=0.3848, $Z_R$=0.0097, $Z_G$=0.0798, $Z_B$=0.3348, $Z_W$=0.4553.

For example, because the RGB grayscale values of the input data signal only comprises the input R sub-grayscale value, the input G sub-grayscale value and the input B sub-grayscale value, accordingly, it can be considered that the input data signal may comprise RGBW grayscale values, and the W sub-grayscale value of the RGBW grayscale values is 0, that is, $W_0$=0. Thus, in the step 10, the formula for calculating the tri-stimulus values is expressed as:

$$\begin{pmatrix} X_0 \\ Y_0 \\ Z_0 \end{pmatrix} = \begin{pmatrix} X_R & X_G & X_B & X_w \\ Y_R & Y_G & Y_B & Y_w \\ Z_R & Z_G & Z_B & Z_w \end{pmatrix} \cdot \begin{pmatrix} R_0 \\ G_0 \\ B_0 \\ 0 \end{pmatrix}$$

For example, the chromaticity coordinate corresponding to the input RGB grayscale values is $x_0$ and $y_0$, and the chromaticity coordinate $x_0$ and $y_0$ reflects the Chroma characteristics of the color, and formulas for calculating the chromaticity coordinate $x_0$ and $y_0$ are expressed as follows:

$$x_0 = \frac{X_0}{X_0+Y_0+Z_0},\ y_0 = \frac{Y_0}{X_0+Y_0+Z_0}.$$

For example, as illustrated in FIG. 2, a P0 point represents a color point corresponding to the input RGB grayscale values in the RGBW color space of the chromaticity diagram, that is, the chromaticity coordinate of the P0 point is ($x_0$, $y_0$).

For example, the chromaticity diagram further comprises a red basic point, a green basic point and a blue basic point. The step S20 comprises: determining the position relationship between the chromaticity coordinate and the white basic point according to the red basic point, the green basic point, the blue basic point, the white basic point and the chromaticity coordinate; and according to the position relationship, calculating the intermediate grayscale values based on the input RGB grayscale values.

For example, the intermediate grayscale values may comprise a first intermediate sub-grayscale value, a second intermediate sub-grayscale value and a third intermediate sub-grayscale value.

For example, as illustrated in FIG. 2, in the chromaticity diagram, a $R_b$ point represents the red basic point, a $G_b$ point represents the green basic point, a $B_b$ point represents the blue basic point, and a $W_b$ point represents the white basic point. The RGBW color space is defined by the red basic point $R_b$, the green basic point $G_b$ and the blue basic point $B_b$, and the white basic point $W_b$ is located in a triangular region surrounded by the red basic point $R_b$, the green basic point $G_b$ and the blue basic point $B_b$. The RGBW color space represents a color range that can be displayed by the display panel employing the method and the device in the embodiment of the present disclosure.

For example, as illustrated in FIG. 2, a triangular region with the red basic point $R_b$, the green basic point $G_b$ and the white basic point $W_b$ as vertices is a first region (that is, a triangular region $R_bG_bW_b$); a triangular region with the red basic point $R_b$, the blue basic point $B_b$ and the white basic point $W_b$ as vertices is a second region (that is, a triangular region $R_bB_bW_b$); a triangular region with the green basic point $G_b$, the blue basic point $B_b$ and the white basic point $W_b$ as vertices is a third region (that is, a triangular region $G_bB_bW_b$).

For example, because the color corresponding to the P0 point can be obtained by mixing colors of RGB, the P0 point is located in a gamut range defined by the red basic point $R_b$, the green basic point $G_b$, the blue basic point $B_b$ and the white basic point $W_b$. As illustrated in FIG. 2, according to the red basic point $R_b$, the green basic point $G_b$, the blue basic point $B_b$, the white basic point Wb and the P0 point, three angles with the white basic point Wb as a vertex can be calculated. The three angles are $\alpha1$, $\alpha2$ and $\alpha3$ respectively, the $\alpha1$ represents an angle composed of the green basic point $G_b$, the white basic point $W_b$ and the P0 point, the $\alpha2$ represents an angle composed of the red basic point $R_b$, the white basic point $W_b$ and the P0 point, and the $\alpha3$ represents an angle composed of the blue basic point $B_b$, the white basic point $W_b$ and the P0 point. For example, the $\alpha1$, $\alpha2$ and $\alpha3$ all can be in a range of 0 degree to 180 degrees. In a case where the $\alpha3$ is greater than the $\alpha1$ and the $\alpha2$, the chromaticity coordinate is located in the first region, that is, the P0 point is located in the triangular region $R_bG_bW_b$. In a case where the $\alpha1$ is greater than the $\alpha2$ and the $\alpha3$, the chromaticity coordinate is located in the second region, that is, the P0 point is located in the triangular region $R_bB_bW_b$. In a case where the $\alpha2$ is greater than the $\alpha1$ and the $\alpha3$, the chromaticity coordinate is located in the third region, that is, the P0 point is located in the triangular region $G_bB_bW_b$. For example, in the example shown in FIG. 2, the $\alpha3$ is greater than the $\alpha1$ and the $\alpha2$, that is, the chromaticity coordinate is located in the first region (that is, the triangular region $R_bG_bW_b$).

For example, the position relationship may be that the chromaticity coordinate is located in the first region, the chromaticity coordinate is located in the second region or the chromaticity coordinate is located in the third region.

For example, in some examples, in a case where the position relationship is that the chromaticity coordinate (that is the P0 point) is located in the first region (that is the triangular region $R_bG_bW_b$), the color corresponding to the chromaticity coordinate can be obtained by mixing red, green and white, so that a blue component in the intermediate grayscale values may be 0, and the formula for calculating the intermediate grayscale values can be expressed as follows:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} R_1 \\ G_1 \\ 0 \\ W_1 \end{pmatrix}$$

in which $R_1$, $G_1$ and $W_1$ represent the first intermediate sub-grayscale value, the second intermediate sub-grayscale value and the third intermediate sub-grayscale value respectively. In this case, the $R_1$ represents the first intermediate sub-grayscale value, the $G_1$ represents the second intermediate sub-grayscale value, and the $W_1$ represents the third intermediate sub-grayscale value.

For example, in other examples, in a case where the position relationship is that the chromaticity coordinate (that is P0 point) is located in the second region (that is the triangular region $R_bB_bW_b$), the color corresponding to the chromaticity coordinate can be obtained by mixing red, blue and white, so that a green component in the intermediate grayscale values is 0, and the formula for calculating the intermediate grayscale values may be expressed as follows:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} R_1 \\ 0 \\ B_1 \\ W_1 \end{pmatrix}$$

in which $R_1$, $B_1$ and $W_1$ represent the first intermediate sub-grayscale value, the second intermediate sub-grayscale value and the third intermediate sub-grayscale value respectively. In this case, the $R_1$ represents the first intermediate sub-grayscale value, the $B_1$ represents the second intermediate sub-grayscale value, and the $W_1$ represents the third intermediate sub-grayscale value.

For example, in some other examples, in a case where the position relationship is that the chromaticity coordinate (that is the P0 point) is located in the third region (that is the triangular region $G_bB_bW_b$), the color corresponding to the chromaticity coordinate can be obtained by mixing green, blue and white, so that a red component in the intermediate grayscale values is 0, and the formula for calculating the intermediate grayscale values may be expressed as follows:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} 0 \\ G_1 \\ B_1 \\ W_1 \end{pmatrix}$$

in which $G_1$, $B_1$ and $W_1$ represent the first intermediate sub-grayscale value, the second intermediate sub-grayscale value and the third intermediate sub-grayscale value respectively. In this case, the $G_1$ represents the first intermediate sub-grayscale value, the $B_1$ represents the second intermediate sub-grayscale value, and the $W_1$ represents the third intermediate sub-grayscale value.

For example, a white component of the intermediate grayscale values is W1, that is, the white component of the intermediate grayscale values is the third intermediate sub-grayscale value.

It should be noted that, as illustrated in FIG. 2, in the CIE 1931 chromaticity diagram, chromaticity coordinates of the red basic point, the green basic point and the blue basic point in the RGBW four-color system can be the same as chromaticity coordinates of the red basic point, the green basic point and the blue basic point in the RGB three-color system, that is, a chromaticity coordinate of the red basic point in the RGBW four-color system can be the same as a chromaticity coordinate of the red basic point in the RGB three-color system, a chromaticity coordinate of the green basic point in the RGBW four-color system can be the same as a chromaticity coordinate of the green basic point in the RGB three-color system, and a chromaticity coordinate of the blue basic point in the RGBW four-color system can be the same as a chromaticity coordinate of the blue basic point in the RGB three-color system. Thus, a gamut range of the RGBW four-color system is basically the same as that of the RGB three-color system. The gamut range of the RGBW four-color system is related to the color performance of the specific display panel, and the color performance of the specific display panel is related to its color generation mechanism. For example, for an LCD display panel, the color performance is related to a color filter adopted; for an OLED display panel, the color performance is related to the color filter adopted and a color conversion layer (a fluorescent layer, a quantum dot layer, etc.) and the like. In a case where the gamut range of the RGBW four-color system is determined, the chromaticity coordinates of the red basic point $R_b$, the green basic point $G_b$, the blue basic point $B_b$ and the white basic point $W_b$ in the CIE 1931 chromaticity diagram can be determined, and the chromaticity coordinates of the red basic point $R_b$, the green basic point $G_b$, the blue basic point $B_b$ and the white basic point $W_b$ are unchanged in the process of data processing.

For example, the step S30 comprises: adjusting the intermediate grayscale values to obtain the output RGBW grayscale values according to a brightness information included in the input RGB grayscale values.

For example, the brightness information included in the input RGB grayscale values may comprise a maximum brightness value corresponding to the chromaticity coordinate (the P0 point shown in FIG. 2). For example, correspondingly, adjusting the intermediate grayscale values to obtain the output RGBW grayscale values according to the brightness information included in the input RGB grayscale values may comprise: calculating the maximum brightness value corresponding to the chromaticity coordinate according to the input RGB grayscale values; according to the input RGB grayscale values and the maximum brightness value, adjusting the intermediate grayscale values to obtain the output RGBW grayscale values.

For example, in some examples, calculating the maximum brightness value corresponding to the chromaticity coordinate according to the input RGB grayscale values comprises: obtaining a maximum value among the input R sub-grayscale value, the input G sub-grayscale value and the input B sub-grayscale value as a maximum input sub-grayscale value; and calculating the maximum brightness value based on the maximum input sub-grayscale value and the input RGB grayscale values.

For example, the maximum input sub-grayscale value may be expressed as:

$$K_{RGB}=\mathrm{MAX}(R_0, G_0, B_0)$$

in which the $K_{RGB}$ represents the maximum input sub-grayscale value. In some examples, the input R sub-grayscale value is 0.5 (that is, $R_0=0.5$), the input G sub-grayscale value is 0.3 (that is, $G_0=0.3$), and the input B sub-grayscale value is 0.7 (that is, $B_0=0.7$). Thus, the maximum input sub-grayscale value is the input B sub-grayscale value, that is, the $K_{RGB}=0.7$. In some other examples, the input R sub-grayscale value is 0.2 (that is, $R_0=0.2$), the input G sub-grayscale value is 0.8 (that is, $G_0=0.8$), and the input B sub-grayscale value is 0.4 (that is, $B_0=0.4$). Thus, the maximum input sub-grayscale value is the input G sub-grayscale value, that is, the $K_{RGB}=0.8$.

For example, the formula for calculating the maximum brightness value corresponding to the chromaticity coordinate is expressed as:

$$\begin{pmatrix} X_{max} \\ Y_{max} \\ Z_{max} \end{pmatrix} = \begin{pmatrix} X_R & X_G & X_B & X_w \\ Y_R & Y_G & Y_B & Y_w \\ Z_R & Z_G & Z_B & Z_w \end{pmatrix} \frac{1}{K_{RGB}} \begin{pmatrix} R_0 \\ G_0 \\ B_0 \\ 0 \end{pmatrix}$$

in which $X_{max}$, $Y_{max}$ and $Z_{max}$ represent the tri-stimulus values corresponding to the maximum brightness value of the chromaticity coordinate, and the $Y_{max}$ represents the maximum brightness value at the P0 point.

For example, a brightness ratio coefficient at the P0 point may be expressed as:

$$K_Y = \frac{Y_0}{Y_{max}}$$

in which the $K_Y$ represents the brightness ratio coefficient at the P0 point. The $K_Y$ reflects the brightness ratio information at the P0 point.

For example, in some examples, adjusting the intermediate grayscale values to obtain the output RGBW grayscale values according to the input RGB grayscale values and the maximum brightness value may comprise: calculating intermediate output RGBW grayscale values according to the input RGB grayscale values and the intermediate grayscale values, in which the intermediate output RGBW grayscale values comprise an intermediate output R sub-grayscale value, an intermediate output G sub-grayscale value, an intermediate output B sub-grayscale value and an intermediate output W sub-grayscale value; obtaining a maximum value among the intermediate output R sub-grayscale value, the intermediate output G sub-grayscale value, the intermediate output B sub-grayscale value and the intermediate output W sub-grayscale value as a maximum intermediate output sub-grayscale value; and calculating the output RGBW grayscale values according to the intermediate output RGBW grayscale values, the maximum intermediate output sub-grayscale value, the maximum brightness value (that is, the maximum brightness value corresponding to the chromaticity coordinate corresponding to the input RGB grayscale values) and the actual brightness value (that is, the actual brightness value corresponding to the input RGB grayscale values).

For example, R2 represents the intermediate output R sub-grayscale value, G2 represents the intermediate output G sub-grayscale value, B2 represents the intermediate output B sub-grayscale value, and W2 represents the intermediate output W sub-grayscale value.

For example, in some examples, in the case where the position relationship is that the chromaticity coordinate is located in the first region, a formula for calculating the intermediate output RGBW grayscale values is expressed as:

$$\begin{pmatrix} R_2 \\ G_2 \\ B_2 \\ W_2 \end{pmatrix} = \begin{pmatrix} R_0 \\ G_0 \\ B_0 \\ 0 \end{pmatrix} + \begin{pmatrix} R_1 \\ G_1 \\ 0 \\ W_1 \end{pmatrix}$$

Thus, $R_2=R_0+R_1$, $G_2=G_0+G_1$, $B_2=B_0$, and $W_2=W_1$.

For example, in other examples, in the case where the position relationship is that the chromaticity coordinate is located in the second region, a formula for calculating the intermediate output RGBW grayscale values is expressed as:

$$\begin{pmatrix} R_2 \\ G_2 \\ B_2 \\ W_2 \end{pmatrix} = \begin{pmatrix} R_0 \\ G_0 \\ B_0 \\ 0 \end{pmatrix} + \begin{pmatrix} R_1 \\ 0 \\ B_1 \\ W_1 \end{pmatrix}$$

Thus, $R_2=R_0+R_1$, $G_2=G_0$, $B_2=B_0+B_1$, and $W_2=W_1$.

For example, in some other examples, in the case where the position relationship is that the chromaticity coordinate is located in the third region, a formula for calculating the intermediate output RGBW grayscale values is expressed as:

$$\begin{pmatrix} R_2 \\ G_2 \\ B_2 \\ W_2 \end{pmatrix} = \begin{pmatrix} R_0 \\ G_0 \\ B_0 \\ 0 \end{pmatrix} + \begin{pmatrix} 0 \\ G_1 \\ B_1 \\ W_1 \end{pmatrix}$$

Thus, $R_2=R_0$, $G_2=G_0+G_1$, $B_2=B_0+B_1$, and $W_2=W_1$.

For example, the chromaticity coordinate corresponding to $R_0$, $G_0$ and $B_0$ calculated according to the above formula (1) is the P0 point shown in FIG. 2. In the case where the chromaticity coordinate is located in the first region, the chromaticity coordinate corresponding to $R_1$, $G_1$ and $W_1$ calculated according to the above formula (1) is also the P0 point shown in FIG. 2. The intermediate output RGBW grayscale values are the result of linear addition of the input RGB grayscale values and the intermediate grayscale values. Thus, the chromaticity coordinate calculated by substituting $R_2$, $G_2$, $B_2$ and $W_2$ into the above formula (1) is also the P0 point shown in FIG. 2. That is to say, the color corresponding to $R_0$, $G_0$ and $B_0$, the color corresponding to $R_1$, $G_1$ and $W_1$ are the same as the color corresponding to $R_2$, $G_2$, $B_2$ and $W_2$. Similarly, in the case where the chromaticity coordinate is located in the second region or the third region, the chromaticity coordinate corresponding to the intermediate output RGBW grayscale values is also the P0 point shown in FIG. 2, repeated portions will be omitted herein.

For example, although $R_0$, $G_0$, $B_0$, $R_1$, $G_1$, $B_1$ are all natural numbers less than or equal to 1, however because the intermediate output RGBW grayscale values are the result of linear addition of the input RGB grayscale values to the intermediate grayscale values, the intermediate output R sub-grayscale value, the intermediate output G sub-grayscale value and the intermediate output B sub-grayscale value (those are $R_2$, $G_2$, $B_2$) may overflow, that is, $R_2$ may be greater than 1, $G_2$ may be greater than 1, and $B_2$ may be greater than 1. Therefore, the intermediate output R sub-grayscale value, the intermediate output G sub-grayscale value and the intermediate output B sub-grayscale value need to be adjusted, so that the intermediate output R sub-grayscale value, the intermediate output G sub-grayscale value and the intermediate output B sub-grayscale value all are in the range of 0.00 to 1.00.

For example, the maximum intermediate output sub-grayscale value may be expressed as:

$$K_m=\mathrm{MAX}(R_2,G_2,B_2,W_2)$$

in which $K_m$ represents the maximum intermediate output sub-grayscale value. In some examples, the intermediate output R sub-grayscale value is 0.8 ($R_2$=0.8), the intermediate output G sub-grayscale value is 1.3 ($G_2$=1.3), the intermediate output B sub-grayscale value is 0.7 ($B_2$=0.7), and the intermediate output W sub-grayscale value is 0.3 ($W_2$=0.3). Thus, the maximum intermediate output sub-grayscale value is the intermediate output G sub-grayscale value, that is to say, $K_m$=1.3.

For example, the RGBW grayscale values corresponding to the maximum intermediate brightness value may be expressed as:

$$\begin{pmatrix} R_m \\ G_m \\ B_m \\ W_m \end{pmatrix} = \frac{1}{K_m} \begin{pmatrix} R_2 \\ G_2 \\ B_2 \\ W_2 \end{pmatrix}$$

in which $R_m$, $G_m$, $B_m$ and $W_m$ represent the maximum intermediate output RGBW grayscale values under the condition of the maximum intermediate brightness value. $R_m$ represents the maximum intermediate output R sub-grayscale value, $G_m$ represents the maximum intermediate output G sub-grayscale value, $B_m$ represents the maximum intermediate output B sub-grayscale value, and $W_m$ represents the maximum intermediate output W sub-grayscale value.

For example, the output RGBW grayscale values can be obtained according to the brightness ratio coefficient at the P0 point and the maximum intermediate output RGBW grayscale values. A formula for calculating the output RGBW grayscale values is expressed as:

$$\begin{pmatrix} R_{out} \\ G_{out} \\ B_{out} \\ W_{out} \end{pmatrix} = K_Y \begin{pmatrix} R_m \\ G_m \\ B_m \\ W_m \end{pmatrix} = \frac{Y_0}{Y_{max} \cdot K_m} \begin{pmatrix} R_m \\ G_m \\ B_m \\ W_m \end{pmatrix}$$

in which $R_{out}$, $G_{out}$, $B_{out}$ and $W_{out}$ represent an output R sub-grayscale value, an output G sub-grayscale value, an output B-grayscale value and an output W sub-grayscale value of the output RGBW grayscale values respectively. $R_{out}$ represents the output R sub-grayscale value, $G_{out}$ represents the output G sub-grayscale value, $B_{out}$ represents the output B sub-grayscale value and $W_{out}$ represents the output W sub-grayscale value. That is to say, $R_{out}$, $G_{out}$, $B_{out}$ and $W_{out}$ are the output RGBW grayscale values obtained by converting the input RGB grayscale values. For example, the output RGBW grayscale values are also normalized values, that is, the output R sub-grayscale value, the output B sub-grayscale value, the output G sub-grayscale value, and the output W sub-grayscale value are also in the range of 0.00 to 1.00. Because the chromaticity coordinate corresponding to the output RGBW grayscale values is the same as the chromaticity coordinate corresponding to the input RGB grayscale value (for example, the P0 point shown in FIG. 2), therefore, after performing the conversion of RGB to RGBW, the color corresponding to the output RGBW grayscale values is the same as the color corresponding to the input RGB grayscale values, which ensures that the color is not distorted and achieves the four-color display, and effectively improves the brightness of the display panel.

Figure 3:
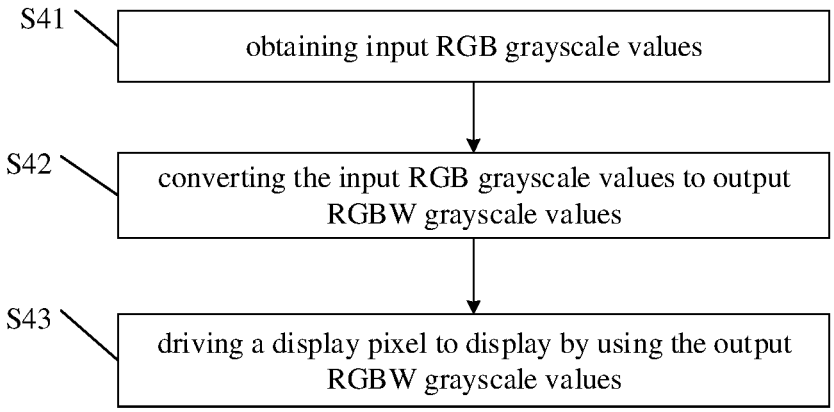
FIG. 3 is a flowchart of an image display driving method provided by at least an embodiment of the present disclosure.

FIG. 3 is a flowchart of an image display driving method provided by at least an embodiment of the present disclosure. For example, as illustrated in FIG. 3, the image display driving method provided by the present disclosure comprises:

S41: obtaining input RGB grayscale values;

S42: converting the input RGB grayscale values to output RGBW grayscale values;

S43: driving a display pixel to display by using the output RGBW grayscale values.

For example, in the step S42, converting the input RGB grayscale values to the output RGBW grayscale values can be achieved by using the data processing method described in any one of the above embodiments, that is to say, the step S42 may comprise the step S10 to S30 in the embodiment of above data processing method. In the image display driving method provided by the present disclosure, the white component of the output RGBW grayscale values is determined according to the position relationship between the chromaticity coordinate of the input RGB grayscale values and the white basic point, so that the conversion from the RGB to the RGBW is implemented, it can be ensured that the color is not distorted (the chromaticity coordinate is unchanged before and after conversion). According to the output RGBW grayscale values, display pixels of the corresponding display panel are driven to display, so as to effectively improve the display brightness and the display effect.

The display panel comprises a pixel array, and the pixel array comprises m rows and n columns of display pixels. For example, in order to display the RGBW grayscale values, each display pixel of the corresponding display panel may comprise a first sub-pixel, a second sub-pixel, a third sub-pixel and a fourth sub-pixel. The first sub-pixel is a red sub-pixel, the second sub-pixel is a green sub-pixel, the third sub-pixel is a blue sub-pixel, and the fourth sub-pixel is a white sub-pixel.

For example, in the step S43, an output R sub-grayscale value of the output RGBW grayscale values is transmitted to the first sub-pixel to drive the first sub-pixel to display, and output G sub-grayscale value of the output RGBW grayscale values is transmitted to the second sub-pixel to drive the second sub-pixel to display, an output B sub-grayscale value of the output RGBW grayscale values is transmitted to the third sub-pixel to drive the third sub-pixel to display, and an output W sub-grayscale value of the output RGBW grayscale values is transmitted to the fourth sub-pixel to drive the fourth sub-pixel to display.

Figure 4:
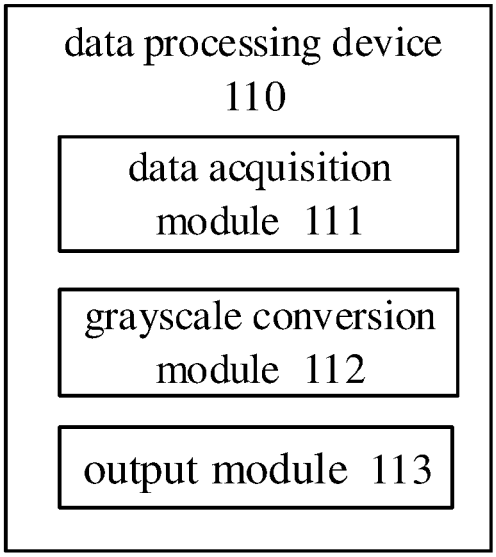
FIG. 4 is a schematic diagram of a data processing device provided by at least an embodiment of the present disclosure.

FIG. 4 is a schematic diagram of a data processing device provided by at least an embodiment of the present disclosure. For example, as illustrated in FIG. 4, the data processing device 110 provided by the embodiment of the present disclosure may comprise a data acquisition module 111, a grayscale conversion module 112, and an output module 113. For example, these components are interconnected by a bus system and/or other forms of connection mechanisms (not shown). It should be noted that, the components and the structures of the data processing device 110 shown in FIG. 4 are only exemplary and not limitative, and the data processing device 110 may also have other components and structures according to requirements.

For example, the data acquisition module 111 is configured to acquire input RGB grayscale values. The grayscale conversion module 112 is configured for: based on the input RGB grayscale values, calculating a chromaticity coordinate of the input RGB grayscale values on a chromaticity diagram, in which the chromaticity diagram comprises a white basic point; calculating to obtain intermediate grayscale values containing a white component, based on the input RGB grayscale values and according to a position relationship between the chromaticity coordinate and the white basic point; and adjusting the intermediate grayscale values to obtain output RGBW grayscale values. The output module 113 is configured for transmitting the output RGBW grayscale values to a display pixel to drive the display pixel to display.

For example, the chromaticity diagram further comprises a red basic point, a green basic point and a blue basic point. The position relationship between the chromaticity coordinate and the white basic point is determined according to the red basic point, the green basic point, the blue basic point, the white basic point and the chromaticity coordinate.

For example, the data acquisition module 111 can perform the step S41 in the embodiment of the above-mentioned image display driving method. The grayscale conversion module 112 can perform the step S42 in the embodiment of the above-mentioned image display driving method. The output module 113 can perform the step S43 in the embodiment of the above-mentioned image display driving method. The repetition is not repeated herein.

It should be noted that, in some embodiments of the present disclosure, the data acquisition module 111, the grayscale conversion module 112 and the output module 113 may comprise hardware devices to implement some or all of the functions of the data acquisition module 111, the grayscale conversion module 112 and the output module 113 as described above. Or, the data acquisition module 111, the grayscale conversion module 112 and the output module 113 may also comprise software modules to achieve some or all of the functions of the data acquisition module 111, the grayscale conversion module 112 and the output module 113 described above. For example, the data acquisition module 111, the grayscale conversion module 112 and the output module 113 may be integrated on a circuit board or integrated on a combination of a plurality of circuit boards to achieve the functions described above. In the embodiment of the present disclosure, the circuit board or the combination of the plurality of circuit boards may comprise: (1) a processor, or a plurality of processors; (2) a non-temporary computer-readable memory connected to the processor, or a plurality of non-temporary computer-readable memories connected to the processors respectively; and (3) a firmware stored in the memory and executable by the processor.

Figure 5:
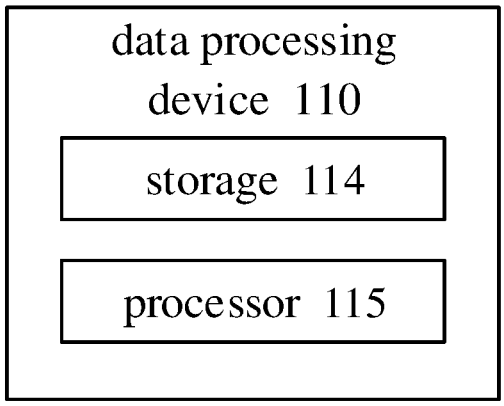
FIG. 5 is a schematic diagram of another data processing device provided by at least an embodiment of the present disclosure.

FIG. 5 is a schematic diagram of another data processing device provided by at least an embodiment of the present disclosure. For example, as illustrated in FIG. 5, the data processing device 110 provided in the embodiment of the present disclosure may comprise a storage 114 and a processor 115. The storage 114 is used for storing a non-temporary computer-readable instruction. The processor 115 is used for executing the non-temporary computer-readable instruction, in which the non-temporary computer-readable instruction is executed by the processor to perform the data processing method according to any one of the described above embodiments.

For example, the processor 115 may be a central processing unit (CPU), a graphics processing unit (GPU), a tensor processing unit (TPU), or other forms of processing units having data processing capabilities and/or program execution capabilities, and can control other components in the data processing device 110 to perform desired functions.

For example, the storage 114 may be implemented by a computer-readable storage medium, and the storage 114 comprises one or more computer program products, and the one or more computer program products comprise various forms of computer-readable storage media, such as a volatile memory and/or a non-volatile memory. The volatile memory comprises, for example, a random access memory (RAM) and/or a high-speed buffer memory (cache). The nonvolatile memory comprises, for example, a read-only memory (ROM), a hard disk, a flash memory, etc. One or more non-temporary computer-readable instructions can be stored on the computer-readable storage medium, and the processor 115 can execute the non-temporary computer-readable instructions to achieve various functions of the data processing device 110. The storage 114 can also be used for storing data needed or generated in the process of executing the computer-readable instruction.

For example, detailed descriptions of the process of data processing by the data processing device 110 can refer to the relevant descriptions in the embodiments of the data processing method, and the repeated descriptions are not repeated herein.

Figure 6:
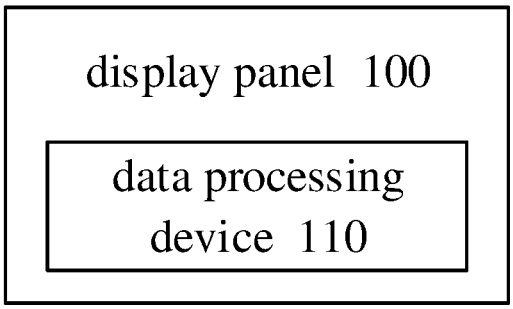
FIG. 6 is a schematic diagram of a display panel provided by at least an embodiment of the present disclosure.

FIG. 6 is a schematic diagram of a display panel provided by at least an embodiment of the present disclosure. For example, as illustrated in FIG. 6, the display panel 100 provided in an embodiment of present disclosure may comprise a data processing device 110, and the data processing device may be the data processing device in any one of the above-mentioned embodiments.

For example, the display panel 100 may be a liquid crystal display panel or an organic light-emitting diode (OLED) display panel, etc.

For example, the display panel 100 may further comprise a time controller (T-con), a gate driver, a data driver, etc. The time controller, the gate driver and the data driver can be manufactured directly on the display panel 100 by an application specific integrated circuit (ASIC) chip or be manufactured by a semiconductor manufacturing process. For example, the data processing device 110 may be integrated into the time controller or into the data driver.

For example, in some examples, the display panel 100 may be applied to any products or components having display functions, such as a mobile phone, a tablet computer, a television, a display, a notebook computer, a digital photo frame, a navigator, etc.

At least one embodiment of the present disclosure further provides a computer-readable storage medium. For example, the computer-readable storage medium is used for storing a non-temporary computer-readable instruction. For example, in a case where the non-temporary computer-readable instruction is executed by a computer, one or more steps of the data processing method in any one of the embodiments described above can be performed.

For example, the computer readable storage medium may be applied to the data processing device described above, for example, the computer readable storage medium may be the storage 114 of the data processing device in the embodiment shown in FIG. 5. The descriptions of the computer readable storage medium may refer to the descriptions of the storage 114 in the embodiment of the data processing device, and the repeated descriptions are not repeated herein.

For example, in some embodiments, in a case where the non-temporary computer-readable instruction is executed by the computer, one or more steps of the image display driving method in any one of the embodiments described above can also be performed.

For the present disclosure, the following points required to be explained:

(1) the drawings of the embodiments of the present disclosure are only related to the structures mentioned in the embodiments of the present disclosure, and other structures can be further obtained by general designs;

(2) the embodiments of the present disclosure and the features therein can be combined with each other to obtain new embodiments in the absence of conflicts.

What are described above is related to only the illustrative embodiments of the present disclosure and not limitative to the protection scope of the present application. The protection scope of the present application shall be defined by the accompanying claims.

What is claimed is:

1. A data processing method, comprising :

based on input RGB grayscale values, calculating a chromaticity coordinate of the input RGB grayscale values on a chromaticity diagram, wherein the chromaticity diagram comprises a white basic point;

determining a calculation formula for calculating intermediate grayscale values containing a white component according to a position relationship between the chromaticity coordinate and the white basic point, calculating the input RGB grayscale values according to the calculation formula to obtain the calculating intermediate grayscale values containing the white component, wherein the white component represents a grayscale value corresponding to the white base point; and adjusting the intermediate grayscale values to obtain output RGBW grayscale values, wherein the input RGB grayscale values comprise an input R sub-grayscale value, an input G sub-grayscale value and an input B sub-grayscale value; and calculating the chromaticity coordinate of the input RGB grayscale values on the chromaticity diagram based on the input RGB grayscale values, comprises:

calculating tri-stimulus values of the chromaticity coordinate according to the input RGB grayscale values; and calculating the chromaticity coordinate according to the tri-stimulus values, wherein a formula for calculating the tri-stimulus values is expressed as:

$$\begin{pmatrix} X_0 \\ Y_0 \\ Z_0 \end{pmatrix} = \begin{pmatrix} X_R & X_G & X_B & X_w \\ Y_R & Y_G & Y_B & Y_w \\ Z_R & Z_G & Z_B & Z_w \end{pmatrix} \begin{pmatrix} R_0 \\ G_0 \\ B_0 \\ 0 \end{pmatrix}$$

wherein $X_0$, $Y_0$ and $Z_0$ represent the tri-stimulus values, and $Y_0$ represents an actual brightness value under the input RGB grayscale values, $R_0$ represents the input R sub-grayscale value, $G_0$ represents the input G sub-grayscale value, $B_0$ represents the input B sub-grayscale value, and $X_R$, $Y_R$, $Z_R$, $X_G$, $Y_G$, $Z_G$, $X_B$, $Y_B$, $Z_B$, $X_W$, $Y_W$, and $Z_W$ are conversion coefficients and are constants;

formulas for calculating the chromaticity coordinate are expressed as follows:

$$x_0 = \frac{X_0}{X_0 + Y_0 + Z_0}, \quad y_0 = \frac{Y_0}{X_0 + Y_0 + Z_0},$$

wherein the chromaticity coordinate comprises $x_0$ and $y_0$, the chromaticity diagram further comprises a red basic point, a green basic point and a blue basic point; and determining the calculation formula for calculating the intermediate grayscale values containing the white component according to the position relationship between the chromaticity coordinate and the white basic point, calculating the input RGB grayscale values according to the calculation formula to obtain the calculating intermediate grayscale values containing the white component comprises:

determining the position relationship between the chromaticity coordinate and the white basic point according to the red basic point, the green basic point, the blue basic point, the white basic point and the chromaticity coordinate; and according to the position relationship, determining the calculation formula for calculating the intermediate grayscale values containing the white component;

calculating the input RGB grayscale values according to the calculation formula to obtain the calculating intermediate grayscale values containing the white component, wherein the intermediate grayscale values comprise a first intermediate sub-grayscale value, a second intermediate sub-grayscale value and a third intermediate sub-grayscale value;

in the chromaticity diagram, a triangular region with the red basic point, the green basic point and the white basic point as vertices is a first region, a triangular region with the red basic point, the blue basic point and the white basic point as vertices is a second region, and a triangular region with the green basic point, the blue basic point and the white basic point as vertices is a third region;

in a case where the position relationship is that the chromaticity coordinate is located in the first region, the calculation formula for calculating the intermediate grayscale values is expressed as:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} R_1 \\ G_1 \\ 0 \\ W_1 \end{pmatrix}$$

wherein $R_1$, $G_1$ and $W_1$ represent the first intermediate sub-grayscale value, the second intermediate sub-grayscale value and the third intermediate sub-grayscale value respectively; or, in a case where the position relationship is that the chromaticity coordinate is located in the second region, the calculation formula for calculating the intermediate grayscale values is expressed as:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} R_1 \\ 0 \\ B_1 \\ W_1 \end{pmatrix}$$

wherein $R_1$, $B_1$ and $W_1$ represent the first intermediate sub-grayscale value, the second intermediate sub-grayscale value and the third intermediate sub-grayscale value respectively; or, in a case where the position relationship is that the chromaticity coordinate is located in the third region, the calculation formula for calculating the intermediate grayscale values is expressed as:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} 0 \\ G_1 \\ B_1 \\ W_1 \end{pmatrix}$$

wherein $G_1$, $B_1$ and $W_1$ represent the first intermediate sub-grayscale value, the second intermediate sub-grayscale value and the third intermediate sub-grayscale value respectively.

2. The data processing method according to claim 1, wherein adjusting the intermediate grayscale values to obtain the output RGBW grayscale values comprises:

adjusting the intermediate grayscale values to obtain the output RGBW grayscale values according to a brightness information included in the input RGB grayscale values.

3. The data processing method according to claim 2, wherein adjusting the intermediate grayscale values to obtain the output RGBW grayscale values according to the brightness information included in the input RGB grayscale values comprises:

calculating a maximum brightness value corresponding to the chromaticity coordinate according to the input RGB grayscale values;

adjusting the intermediate grayscale values to obtain the output RGBW grayscale values according to the input RGB grayscale values and the maximum brightness value.

4. The data processing method according to claim 3, wherein calculating the maximum brightness value corresponding to the chromaticity coordinate according to the input RGB grayscale values comprises:

obtaining a maximum value among the input R sub-grayscale value, the input G sub-grayscale value and the input B sub-grayscale value as a maximum input sub-grayscale value; and calculating the maximum brightness value based on the maximum input sub-grayscale value and the input RGB grayscale values, wherein a formula for calculating the maximum brightness value is expressed as:

$$\begin{pmatrix} X_{max} \\ Y_{max} \\ Z_{max} \end{pmatrix} = \begin{pmatrix} X_R & X_G & X_B & X_w \\ Y_R & Y_G & Y_B & Y_w \\ Z_R & Z_G & Z_B & Z_w \end{pmatrix} \frac{1}{K_{RGB}} \begin{pmatrix} R_0 \\ G_0 \\ B_0 \\ 0 \end{pmatrix}$$

wherein $X_{max}$, $Y_{max}$ and $Z_{max}$ represent tri-stimulus values corresponding to the maximum brightness value of the chromaticity coordinate, $Y_{max}$ represents the maximum brightness value, and $K_{RGB}$ represents the maximum input sub-grayscale value.

5. The data processing method according to claim 4, wherein adjusting the intermediate grayscale values to obtain the output RGBW grayscale values according to the input RGB grayscale values and the maximum brightness value comprises:

calculating intermediate output RGBW grayscale values according to the input RGB grayscale values and the intermediate grayscale values, wherein the intermediate output RGBW grayscale values comprise an intermediate output R sub-grayscale value, an intermediate output G sub-grayscale value, an intermediate output B sub-grayscale value and an intermediate output W sub-grayscale value;

obtaining a maximum value among the intermediate output R sub-grayscale value, the intermediate output G sub-grayscale value, the intermediate output B sub-grayscale value and the intermediate output W sub-grayscale value as a maximum intermediate output sub-grayscale value;

calculating the output RGBW grayscale values according to the intermediate output RGBW grayscale values, the maximum intermediate output sub-grayscale value, the maximum brightness value and the actual brightness value.

6. The data processing method according to claim 5, wherein, in the case where the position relationship is that the chromaticity coordinate is located in the first region, a formula for calculating the intermediate output RGBW grayscale values is expressed as:

$$\begin{pmatrix} R_2 \\ G_2 \\ B_2 \\ W_2 \end{pmatrix} = \begin{pmatrix} R_0 \\ G_0 \\ B_0 \\ 0 \end{pmatrix} + \begin{pmatrix} R_1 \\ G_1 \\ 0 \\ W_1 \end{pmatrix}$$

or, in the case where the position relationship is that the chromaticity coordinate is located in the second region, a formula for calculating the intermediate output RGBW grayscale values is expressed as:

$$\begin{pmatrix} R_2 \\ G_2 \\ B_2 \\ W_2 \end{pmatrix} = \begin{pmatrix} R_0 \\ G_0 \\ B_0 \\ 0 \end{pmatrix} + \begin{pmatrix} R_1 \\ 0 \\ B_1 \\ W_1 \end{pmatrix}$$

or, in the case where the position relationship is that the chromaticity coordinate is located in the third region, a formula for calculating the intermediate output RGBW grayscale values is expressed as:

$$\begin{pmatrix} R_2 \\ G_2 \\ B_2 \\ W_2 \end{pmatrix} = \begin{pmatrix} R_0 \\ G_0 \\ B_0 \\ 0 \end{pmatrix} + \begin{pmatrix} 0 \\ G_1 \\ B_1 \\ W_1 \end{pmatrix}$$

wherein $R_2$, $G_2$, $B_2$ and $W_2$ represent the intermediate output R sub-grayscale value, the intermediate output G sub-grayscale value, the intermediate output B sub-grayscale value and the intermediate output W sub-grayscale value respectively.

7. The data processing method according to claim 6, wherein a formula for calculating the output RGBW grayscale values is expressed as:

$$\begin{pmatrix} R_{out} \\ G_{out} \\ B_{out} \\ W_{out} \end{pmatrix} = \frac{Y_0}{Y_{max} \cdot K_m} \begin{pmatrix} R_2 \\ G_2 \\ B_2 \\ W_2 \end{pmatrix}$$

wherein $R_{out}$, $G_{out}$, $B_{out}$ and $W_{out}$ represent an output R sub-grayscale value, an output G sub-grayscale value, an output B sub-grayscale value and an output W sub-grayscale value of the output RGBW grayscale values respectively, and $K_m$ represents the maximum intermediate output sub-grayscale value.

8. A data processing device, comprising:

a storage, which is used for storing a non-temporary computer-readable instruction; and a processor, which is used for executing the non-temporary computer-readable instruction, wherein the non-temporary computer-readable instruction is executed by the processor to perform the data processing method according to claim 1.

9. A computer-readable storage medium, which is used for storing a non-temporary computer-readable instruction, wherein the non-temporary computer-readable instruction is executed by a computer to perform the data processing method according to claim 1.

10. An image display driving method, comprising:

obtaining input RGB grayscale values;

based on the input RGB grayscale values, calculating a chromaticity coordinate of the input RGB grayscale values on a chromaticity diagram, wherein the chromaticity diagram comprises a white basic point;

determining a calculation formula for calculating intermediate grayscale values containing a white component according to a position relationship between the chromaticity coordinate and the white basic point, calculating the input RGB grayscale values according to the calculation formula to obtain the calculating intermediate grayscale values containing the white component, wherein the white component represents a grayscale value corresponding to the white base point;

adjusting the intermediate grayscale values to obtain output RGBW grayscale values; and driving a display pixel to display by using the output RGBW grayscale values, wherein the input RGB grayscale values comprise an input R sub-grayscale value, an input G sub-grayscale value and an input B sub-grayscale value; and calculating the chromaticity coordinate of the input RGB grayscale values on the chromaticity diagram based on the input RGB grayscale values, comprises:

calculating tri-stimulus values of the chromaticity coordinate according to the input RGB grayscale values; and calculating the chromaticity coordinate according to the tri-stimulus values, wherein a formula for calculating the tri-stimulus values is expressed as:

$$\begin{pmatrix} X_0 \\ Y_0 \\ Z_0 \end{pmatrix} = \begin{pmatrix} X_R & X_G & X_B & X_w \\ Y_R & Y_G & Y_B & Y_w \\ Z_R & Z_G & Z_B & Z_w \end{pmatrix} \begin{pmatrix} R_0 \\ G_0 \\ B_0 \\ 0 \end{pmatrix}$$

wherein $X_0$, $Y_0$ and $Z_0$ represent the tri-stimulus values, and $Y_0$ represents an actual brightness value under the input RGB grayscale values, $R_0$ represents the input R sub-grayscale value, $G_0$ represents the input G sub-grayscale value, $B_0$ represents the input B sub-grayscale value, and $X_R$, $Y_R$, $Z_R$, $X_G$, $Y_G$, $Z_G$, $X_B$, $Y_B$, $Z_B$, $X_W$, $Y_W$, and $Z_W$ are conversion coefficients and are constants;

formulas for calculating the chromaticity coordinate are expressed as follows:

$$x_0 = \frac{X_0}{X_0 + Y_0 + Z_0}, \quad y_0 = \frac{Y_0}{X_0 + Y_0 + Z_0},$$

wherein the chromaticity coordinate comprises $x_0$ and $y_0$, the chromaticity diagram further comprises a red basic point, a green basic point and a blue basic point; and determining the calculation formula for calculating the intermediate grayscale values containing the white component according to the position relationship between the chromaticity coordinate and the white basic point, calculating the input RGB grayscale values according to the calculation formula to obtain the calculating intermediate grayscale values containing the white component comprises:

determining the position relationship between the chromaticity coordinate and the white basic point according to the red basic point, the green basic point, the blue basic point, the white basic point and the chromaticity coordinate; and according to the position relationship, determining the calculation formula for calculating the intermediate grayscale values containing the white component;

calculating the input RGB grayscale values according to the calculation formula to obtain the calculating intermediate grayscale values containing the white component, wherein the intermediate grayscale values comprise a first intermediate sub-grayscale value, a second intermediate sub-grayscale value and a third intermediate sub-grayscale value;

in the chromaticity diagram, a triangular region with the red basic point, the green basic point and the white basic point as vertices is a first region, a triangular region with the red basic point, the blue basic point and the white basic point as vertices is a second region, and a triangular region with the green basic point, the blue basic point and the white basic point as vertices is a third region;

in a case where the position relationship is that the chromaticity coordinate is located in the first region, the calculation formula for calculating the intermediate grayscale values is expressed as:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} R_1 \\ G_1 \\ 0 \\ W_1 \end{pmatrix}$$

wherein $R_1$, $G_1$ and $W_1$ represent the first intermediate sub-grayscale value, the second intermediate sub-grayscale value and the third intermediate sub-grayscale value respectively; or, in a case where the position relationship is that the chromaticity coordinate is located in the second region, the calculation formula for calculating the intermediate grayscale values is expressed as:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} R_1 \\ 0 \\ B_1 \\ W_1 \end{pmatrix}$$

wherein $R_1$, $B_1$ and $W_1$ represent the first intermediate sub-grayscale value, the second intermediate sub-grayscale value and the third intermediate sub-grayscale value respectively; or, in a case where the position relationship is that the chromaticity coordinate is located in the third region, the calculation formula for calculating the intermediate grayscale values is expressed as:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} 0 \\ G_1 \\ B_1 \\ W_1 \end{pmatrix}$$

wherein $G_1$, $B_1$ and $W_1$ represent the first intermediate sub-grayscale value, the second intermediate sub-grayscale value and the third intermediate sub-grayscale value respectively.

11. The image display driving method according to claim 10, wherein the display pixel comprises a first sub-pixel, a second sub-pixel, a third sub-pixel and a fourth sub-pixel;

an output R sub-grayscale value of the output RGBW grayscale values is transmitted to the first sub-pixel to drive the first sub-pixel to display;

an output G sub-grayscale value of the output RGBW grayscale values is transmitted to the second sub-pixel to drive the second sub-pixel to display;

an output B sub-grayscale value of the output RGBW grayscale values is transmitted to the third sub-pixel to drive the third sub-pixel to display; and an output W sub-grayscale value of the output RGBW grayscale values is transmitted to the fourth sub-pixel to drive the fourth sub-pixel to display.

12. A data processing device, comprising:

a data acquisition module, configured to acquire input RGB grayscale values;

a grayscale conversion module, which is configured for: based on the input RGB grayscale values, calculating a chromaticity coordinate of the input RGB grayscale values on a chromaticity diagram, wherein the chromaticity diagram comprises a white basic point;

determining a calculation formula for calculating intermediate grayscale values containing a white component according to a position relationship between the chromaticity coordinate and the white basic point, calculating the input RGB grayscale values according to the calculation formula to obtain the calculating intermediate grayscale values containing the white component, wherein the white component represents a grayscale value corresponding to the white base point; and adjusting the intermediate grayscale values to obtain output RGBW grayscale values; and an output module, which is configured for transmitting the output RGBW grayscale values to a display pixel to drive the display pixel to display, wherein the input RGB grayscale values comprise an input R sub-grayscale value, an input G sub-grayscale value and an input B sub-grayscale value; and calculating the chromaticity coordinate of the input RGB grayscale values on the chromaticity diagram based on the input RGB grayscale values, comprises:

calculating tri-stimulus values of the chromaticity coordinate according to the input RGB grayscale values; and calculating the chromaticity coordinate according to the tri-stimulus values, wherein a formula for calculating the tri-stimulus values is expressed as:

$$\begin{pmatrix} X_0 \\ Y_0 \\ Z_0 \end{pmatrix} = \begin{pmatrix} X_R & X_G & X_B & X_w \\ Y_R & Y_G & Y_B & Y_w \\ Z_R & Z_G & Z_B & Z_w \end{pmatrix} \begin{pmatrix} R_0 \\ G_0 \\ B_0 \\ 0 \end{pmatrix}$$

wherein $X_0$, $Y_0$ and $Z_0$ represent the tri-stimulus values, and $Y_0$ represents an actual brightness value under the input RGB grayscale values, $R_0$ represents the input R sub-grayscale value, $G_0$ represents the input G sub-grayscale value, $B_0$ represents the input B sub-grayscale value, and $X_R$, $Y_R$, $Z_R$, $X_G$, $Y_G$, $Z_G$, $X_B$, $Y_B$, $Z_B$, $X_W$, $Y_W$ and $Z_W$ are conversion coefficients and are constants;

formulas for calculating the chromaticity coordinate are expressed as follows:

$$x_0 = \frac{X_0}{X_0 + Y_0 + Z_0}, \quad y_0 = \frac{Y_0}{X_0 + Y_0 + Z_0},$$

wherein the chromaticity coordinate comprises $x_0$ and $y_0$, the chromaticity diagram further comprises a red basic point, a green basic point and a blue basic point; and determining the calculation formula for calculating the intermediate grayscale values containing the white component according to the position relationship between the chromaticity coordinate and the white basic point, calculating the input RGB grayscale values according to the calculation formula to obtain the calculating intermediate grayscale values containing the white component comprises:

determining the position relationship between the chromaticity coordinate and the white basic point according to the red basic point, the green basic point, the blue basic point, the white basic point and the chromaticity coordinate; and according to the position relationship, determining the calculation formula for calculating the intermediate grayscale values containing the white component;

calculating the input RGB grayscale values according to the calculation formula to obtain the calculating intermediate grayscale values containing the white component, wherein the intermediate grayscale values comprise a first intermediate sub-grayscale value, a second intermediate sub-grayscale value and a third intermediate sub-grayscale value;

in the chromaticity diagram, a triangular region with the red basic point, the green basic point and the white basic point as vertices is a first region, a triangular region with the red basic point, the blue basic point and the white basic point as vertices is a second region, and a triangular region with the green basic point, the blue basic point and the white basic point as vertices is a third region;

in a case where the position relationship is that the chromaticity coordinate is located in the first region, the calculation formula for calculating the intermediate grayscale values is expressed as:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} R_1 \\ G_1 \\ 0 \\ W_1 \end{pmatrix}$$

wherein $R_1$, $G_1$ and $W_1$ represent the first intermediate sub-grayscale value, the second intermediate sub-grayscale value and the third intermediate sub-grayscale value respectively; or, in a case where the position relationship is that the chromaticity coordinate is located in the second region, the calculation formula for calculating the intermediate grayscale values is expressed as:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} R_1 \\ 0 \\ B_1 \\ W_1 \end{pmatrix}$$

wherein $R_1$, $B_1$ and $W_1$ represent the first intermediate sub-grayscale value, the second intermediate sub-grayscale value and the third intermediate sub-grayscale value respectively; or, in a case where the position relationship is that the chromaticity coordinate is located in the third region, the calculation formula for calculating the intermediate grayscale values is expressed as:

$$\begin{pmatrix} X_0 \\ Y_0 \\ Z_0 \end{pmatrix} = \begin{pmatrix} X_R & X_G & X_B & X_W \\ Y_R & Y_G & Y_B & Y_W \\ Z_R & Z_G & Z_B & Z_W \end{pmatrix} \cdot \begin{pmatrix} 0 \\ G_1 \\ B_1 \\ W_1 \end{pmatrix}$$

wherein $G_1$, $B_1$ and $W_1$ represent the first intermediate sub-grayscale value, the second intermediate sub-grayscale value and the third intermediate sub-grayscale value respectively.

13. A display panel, comprising the data processing device according to claim 12.

* * * * *